United States Patent [19]

Terauchi et al.

[11] 4,332,535

[45] Jun. 1, 1982

[54] SCROLL TYPE COMPRESSOR HAVING AN OIL SEPARATOR AND OIL SUMP IN THE SUCTION CHAMBER

[75] Inventors: Kiyoshi Terauchi; Masaharu Hiraga, both of Isesaki, Japan

[73] Assignee: Sankyo Electric Company Limited, Isesaki, Japan

[21] Appl. No.: 103,393

[22] Filed: Dec. 13, 1979

[30] Foreign Application Priority Data

Dec. 16, 1978 [JP] Japan ..... 53-155198
Feb. 17, 1979 [JP] Japan ..... 54-16743

[51] Int. Cl.[3] ..... F04C 18/02; F04C 29/02

[52] U.S. Cl. ..... 418/55; 418/94; 418/DIG. 1

[58] Field of Search ..... 418/55, 94, 100, DIG. 1, 418/97–99

[56] References Cited

U.S. PATENT DOCUMENTS

| | | | |
|---|---|---|---|
| 2,606,715 | 8/1952 | Martin | 418/100 |
| 3,797,972 | 3/1974 | Nakayama et al. | 418/100 |
| 3,874,827 | 4/1975 | Young | 418/55 |
| 4,129,405 | 12/1978 | McCullough | 418/55 |
| 4,216,661 | 8/1980 | Tojo et al. | 418/55 |

FOREIGN PATENT DOCUMENTS

| | | | |
|---|---|---|---|
| 1165435 | 10/1969 | United Kingdom | 418/55 |

*Primary Examiner*—John J. Vrablik
*Attorney, Agent, or Firm*—Hopgood, Calimafde, Kalil, Blaustein & Judlowe

[57] ABSTRACT

A scroll type compressor unit including a compressor housing having fluid inlet and outlet ports, and two fixed and orbiting scroll members within the compressor housing. Each scroll member has an end plate and a spiral element which are maintained angularly and radially offset so that both spiral elements interfit with a line contacts between the spiral curved surfaces to define moving sealed off pockets. In order that the fluid may be reliably taken into all fluid pockets, the end plate of the fixed scroll member is formed with a suction port connecting to the fluid inlet port at a position adjacent to the outer terminal end of the orbiting spiral element. Thus, the fluid introduced through the suction port may be taken into a fluid pocket which is formed at the outer terminal end portion of the orbiting spiral element and is sent along the outer surface of the orbiting spiral element to a fluid pocket which is formed at the outer terminal end of the fixed spiral element. The fixed spiral element is formed so that its outer terminal end engages with the inner surface of the compressor housing, and a seal plate member is disposed to close the gap between the inner surface of the housing and the peripheral surface of the orbiting end plate. This permits the fluid sent to the outer terminal end portion of the fixed spiral element to be pre-compressed.

7 Claims, 17 Drawing Figures

SCROLL TYPE COMPRESSOR HAVING AN OIL SEPARATOR AND OIL SUMP IN THE SUCTION CHAMBER

BACKGROUND OF THE INVENTION

This invention relates to fluid displacement apparatus, and in particular, to fluid compressor units of the scroll type.

Scroll type apparatus has been well known in the prior art as disclosed in, for example, U.S. Pat. No. 801,182, and others, which discloses a device including scroll members each having an end plate and a spiroidal or involute spiral element. Scroll members are maintained angularly and radially offset so that both spiral elements interfit at a plurality of line contacts between the spiral curved surfaces to thereby seal off and define at least one fluid pocket. The relative orbital motion of these scroll members shifts the contact line along the spiral curved surfaces and, therefore, the fluid pocket changes in volume. The volume of the fluid pocket increases or decreases dependent on the direction of the orbital motion. Therefore, scroll type apparatus is applicable to compress, expand or pump fluids.

In comparison with conventional compressors of the piston type, a scroll type compressor has certain advantages such as fewer number of parts, continuous compression of fluid and others. However, there have been several problems; primarily sealing of the fluid pocket, wearing of the spiral elements, and inlet and outlet porting.

Although there have been many patents, for example, U.S. Pat. Nos. 3,884,599, 3,924,977, 3,994,633, 3,994,635, and 3,994,636 directed to resolving these and other problems, the resultant compressor is complicated in construction and in production.

It is desired that the fluid introduced into the compressor housing be reliably taken into all the fluid pockets between both scroll members, in order to effectively compress the fluid.

Furthermore, in order to increase compressive capacity and compression ratio, it is required that the number of turns of each spiral element be increased. This means that the radius of the compressor housing is also increased.

Additionally, a compressor unit of the scroll type should be provided with a lubricating system for lubricating its moving parts.

SUMMARY OF THE INVENTION

It is an object of this invention to provide a scroll type compressor unit wherein the fluid introduced into the compressor housing is effectively taken into all fluid pockets between both scroll members.

It is another object of this invention to provide a scroll type compressor unit wherein the interior of the compressor housing is well used in the compression of the fluid to increase the compressive capacity without an increase in the volume of the compressor housing.

It is still another object of this invention to provide a scroll type compressor unit having an improved lubricating system.

It is yet another object of this invention to achieve the above mentioned objects with simplicity in construction and production.

According to this invention, a scroll type compressor unit is provided which includes a compressor housing having a fluid inlet port and fluid outlet port. A fixed scroll member having first end plate means to which first wrap means are affixed, is fixedly disposed in the compressor housing so that a chamber is defined by the inner surface of the compressor housing and the first end plate means of the fixed scroll member. The first wrap means are disposed in the chamber. An orbiting scroll member having second end plate means and second wrap means affixed thereon is orbitally disposed within the chamber in such a fashion that the second wrap means and first wrap means interfit at angular offset of 180° at a plurality of line contacts to define at least one pair of sealed off fluid pockets. Each fluid pocket moves with a consequent reduction of volume by the orbital motion of the orbiting scroll member to thereby compress the fluid in the pocket. The first end plate means are provided with a first hole outside the first wrap means and adjacent to the outer terminal end of the second wrap means and with second hole at a position corresponding to the center of the first wrap means. The first hole is connected with the fluid inlet port to introduce the fluid from the inlet port into the chamber. A portion of the fluid is taken into a space between the outer terminal end portion of the second wrap means and the adjacent first wrap means for compression. The other portion of the fluid is guided along the second wrap means into another space between the outer terminal end portion of the first wrap means and the adjacent second wrap means for compression. A second hole is connected with the fluid outlet port so that the compressed fluid is discharged from the second hole and the outlet port.

First means for closing a gap between the outer peripheral end of the second end plate means and the inner surface of the compressor housing, but permitting the orbital motion of the orbiting scroll member is provided within the compressor housing the fluid introduced through the first hole to be confined in the space between the first and second end plate means.

The first wrap means extends along the first end plate means so that its outer terminal end engages with the inner surface of the compressor housing. The second wrap means includes the same number of turns as the first wrap means. The fluid introduced through the first hole of the first end plate is partially guided into the space between the outer terminal end portion and the adjacent second wrap means along the outer surface of the outer terminal end portion of the second wrap means, while being compressed.

According to another aspect of the invention, the compressor housing includes a rear end plate which is provided with a suction chamber and a discharge chamber. The rear end plate is provided with a fluid inlet port which is connected to the suction chamber and an outlet port which is connected to the discharge chamber. The suction and discharge chambers are disposed along a side opposite to the chamber within the interior of the compressor housing in reference to the first end plate of the fixed scroll member, and connect to the first and second holes, respectively. The fixed scroll member is oriented so that the first hole is disposed at an upper position of the compressor housing. In the suction chamber, an oil separator plate is disposed to prevent the fluid from flowing into the first hole of the first end plate. Accordingly, the fluid strikes the oil separator from the plate before flowing into the first hole and is separated oil mixed therein. The separated oil is accumulated in the lower portion of the suction chamber, and returns from to the chamber defined in the compressor housing through an oil passageway. Thus, the oil which flows into the fluid circulating circuit together with the compressed fluid, is separated in the suction chamber and returns into the chamber to be used for lubricating moving parts in the compressor housing.

Further objects, features and other aspects of this invention will be understood from the following detailed description of preferred embodiments of this invention referring to the annexed drawings.

DETAILED DESCRIPTION OF PREFERRED EMBODIMENTS

Figure 1A:
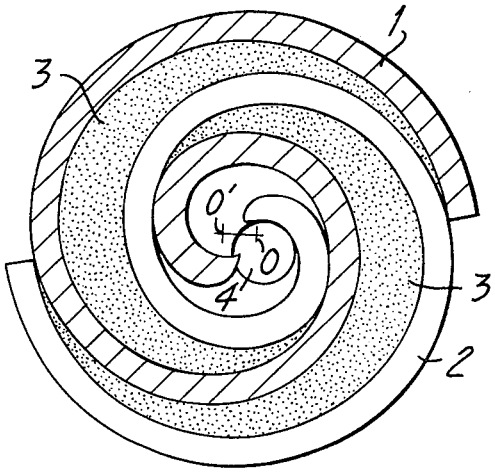
FIGS. 1*a*–1*d* are views illustrating the principle of operation of the scroll type compressor.

Before preferred embodiments of this invention will be described, the principle of operation of the scroll type compressor unit is described with reference to FIGS. 1*a*–1*d*.

When two spiral elements or wrap means 1 and 2 are angularly offset and disposed interfitting with one another, spaces or fluid pockets 3 (dotted regions) are defined by the contacting portions of both spiral elements and are formed between both spiral elements, as shown in the figures. When spiral element 1 is moved in relation to the other spiral element 2 so that the center O′ of spiral element 1 revolves around the center O of spiral element 2 in a radius of O—O′ and while the rotation of spiral element 1 is prevented, fluid pockets 3 shift angularly and radially towards the center of the interfitted spiral elements with the volume of each fluid pocket 3 being gradually reduced, as shown in FIGS. 1*a*–1*d*. Therefore, the fluid in each pocket is compressed.

Figure 1B:
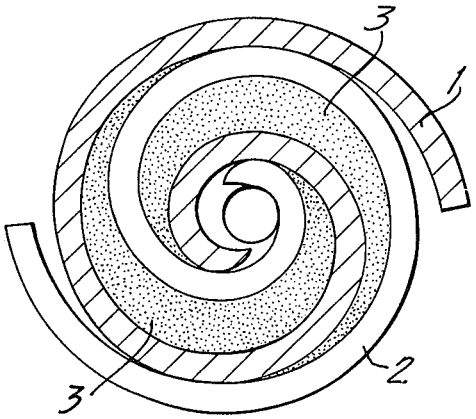
Figure 1C:
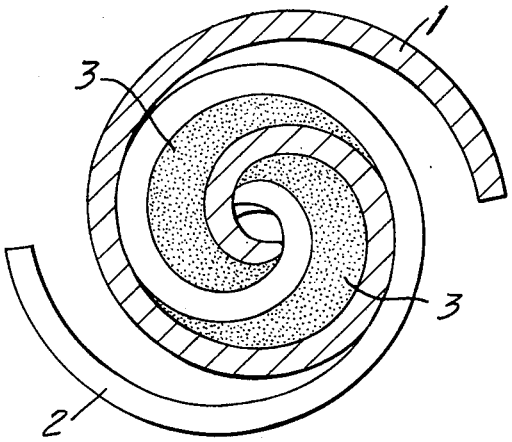
Figure 1D:
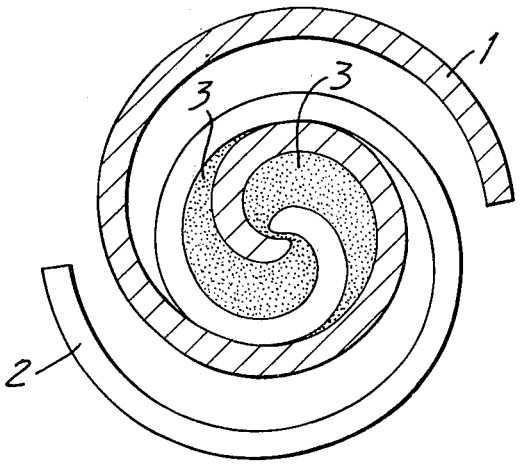

In the status after revolution through a 360° angle, as shown in FIG. 1*a*, both pockets 3 are disposed at the central portion and are connected to one another to form a single pocket, volume of the connected single pocket is further reduced by further revolution through 90° angles as shown in FIGS. 1*b*, 1*c* and 1*d*, and is substantially zero in the status shown in FIG. 1*d*. During the course of rotation, outer spaces which open in the status shown in FIG. 1*b* shown in FIGS. 1*c*, 1*d* and 1*a*, to form new sealed off pockets in which fluid is newly enclosed.

Accordingly, if circular plates are disposed at, and sealed to, axial opposite ends of spiral elements 1 and 2, respectively, and if one of the circular plates is provided with a discharge port 4 at the center thereof as shown in the figures, fluid is taken into fluid pockets at the radial outer portion and is discharged from the discharge port 4 after compression.

As will be understood from above description, fluid pockets are periodically and newly formed at the outer terminal end portions of the respective spiral elements, by the relative orbital motion of spiral elements. Therefore, in order to obtain effective compression, the fluid must be fed to the outer terminal end portions of the respective spiral elements so that all fluid pockets may be used for fluid compression.

Since the outer terminal end portions of respective spiral elements are disposed at positions which are angularly offset from one another by an angle of about 180°, the feeding of fluid to the respective outer terminal ends of the spiral elements is difficult and requires a complicated construction.

Briefly stated, one aspect of this invention is to introduce fluid in a chamber, in which the scroll members are disposed, at a position adjacent to the outer terminal end of the spiral element of the orbiting scroll member and to guide a portion of the introduced fluid along the outer surface of the spiral element of the orbiting scroll member to the outer terminal end portion of the spiral element of the fixed scroll member.

Figure 2:
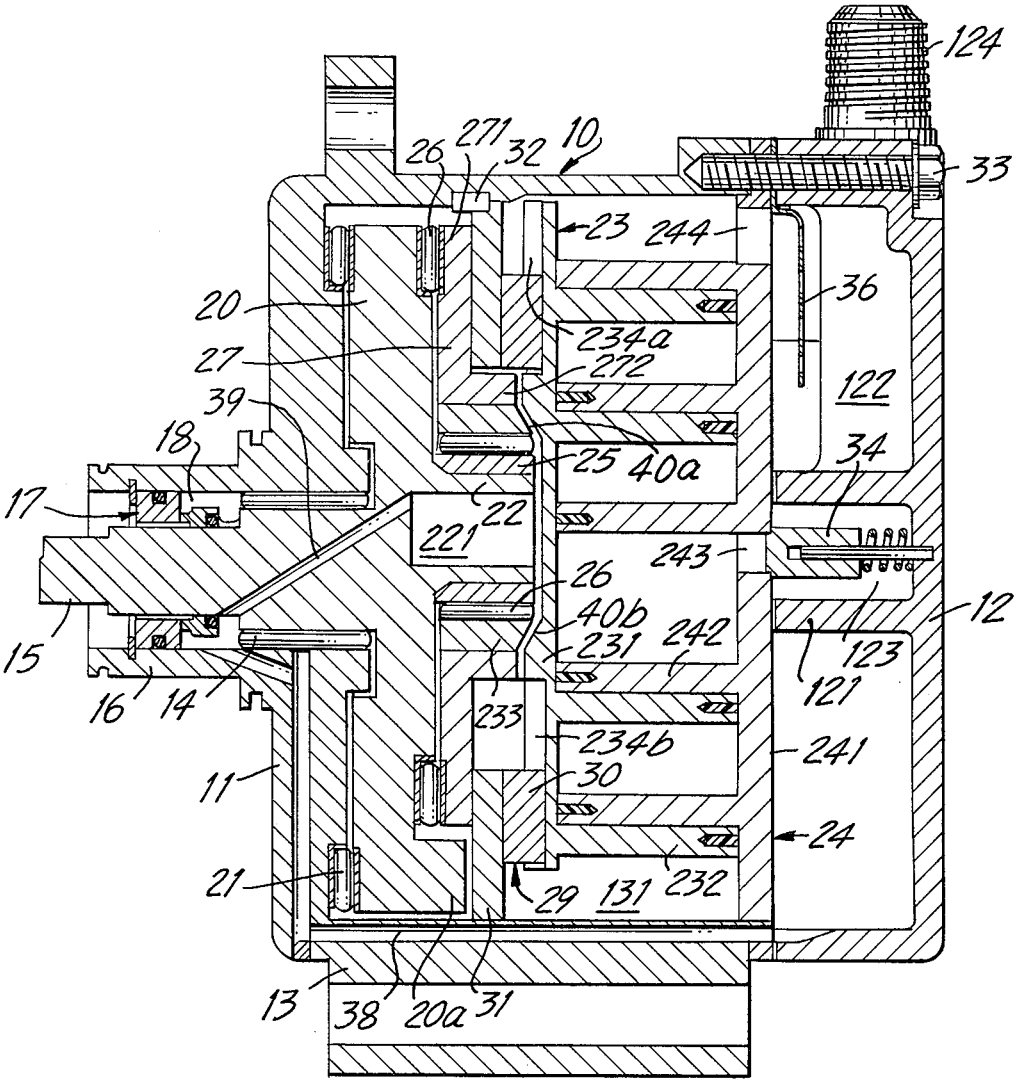
FIG. 2 is a vertical sectional view of a compressor unit of an embodiment of this invention.
Figure 3:
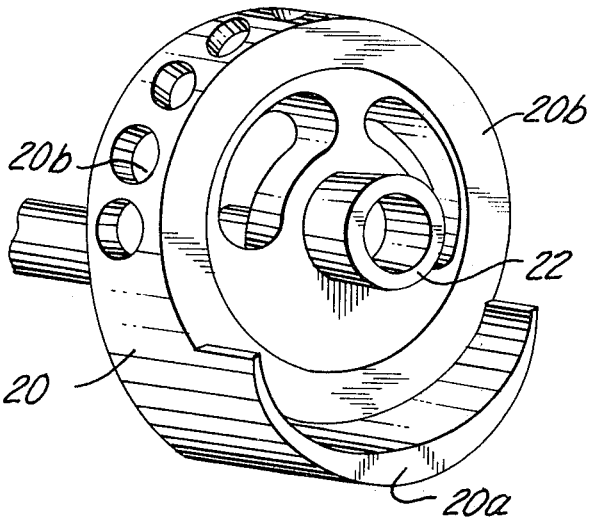
FIG. 3 is a perspective view of the rotor in the embodiment of FIG. 2.

Referring to FIG. 2, a refrigerant compressor unit 10 of the embodiment shown includes a compressor housing including a front end plate 11, a rear end plate 12 and a cylindrical body 13 connecting between the end plates. Front end plate 11 is shown integrally formed with cylindrical body 13. The compressor housing defines a sealed off chamber which communicates outside the compressor housing through a fluid inlet port 124 and a fluid outlet port (125, in FIG. 10) formed in rear end plate 12. A drive shaft 15 is rotatably supported by a radial needle bearing 14 in front end plate 11. Front end plate 11 has a sleeve portion 16 projecting from the front surface thereof and surrounding drive shaft 15 to define a shaft seal cavity 18. Within shaft seal cavity 18, a shaft seal assembly 17 is disposed on drive shaft 15. Drive shaft 15 is driven by an external power source (not shown) through rotational force transmitting means, such as a pulley connected the drive shaft 15 and belt means connecting between the pulley and the external power source. A disk rotor 20 is fixedly mounted on an inner end of drive shaft 15 and is born on the inner surface of front end plate 11 through a thrust needle bearing 21 which is disposed concentrically with drive shaft 15. Rotor 20 is integrally formed with drive shaft 15 in the shown embodiment. Rotor 20 is provided with a balance weight 20*a* and balance hole 20*b* to compensate for dynamic unbalance as shown in FIG. 3. Disk rotor 20 is also provided with a drive pin 22 projecting from the rear end surface thereof. Drive pin 22 is radially offset from drive shaft 15 by a predetermined length.

Reference numerals 23 and 24 represent a pair of interfitting orbiting and fixed scroll members respectively. Orbiting scroll member 23 includes an circular end plate 231 and a wrap means or spiral element 232 affixed onto one surface of circular plate 231. Circular plate 231 is provided with a boss 233 projecting from the other end surface thereof. Drive pin 22 is fitted into boss 233 with a bush 25 and a radial needle bearing 26 therebetween, so that orbiting scroll member 23 is rotatably supported on drive pin 22.

A hollow member 27 having a radial flange 271 is non-rotatably fitted onto boss 233 by means of a key and keyway connection. Radial flange 271 is supported on the rear end surface of disk rotor 20 by a thrust needle bearing 28 which is concentrically disposed with drive pin 22. The axial length of hollow member 27 is equal to, or longer than, the axial length of boss 233, so that the thrust load from orbiting scroll member 23 is supported on front end plate 11 through disk rotor 20. Therefore, the rotation of drive shaft 15 effects the orbital motion of orbiting scroll member 23 together with hollow member 27. Specifically, orbiting scroll member 23 moves along a circle equal to of a radius of the length between drive shaft 15 and drive pin 22.

Means 29 for preventing orbiting scroll member 23 from rotating during its orbital motion are disposed between circular plate 231 of orbiting scroll member 23 and radial flange 271 of hollow member 27.

Figure 4:
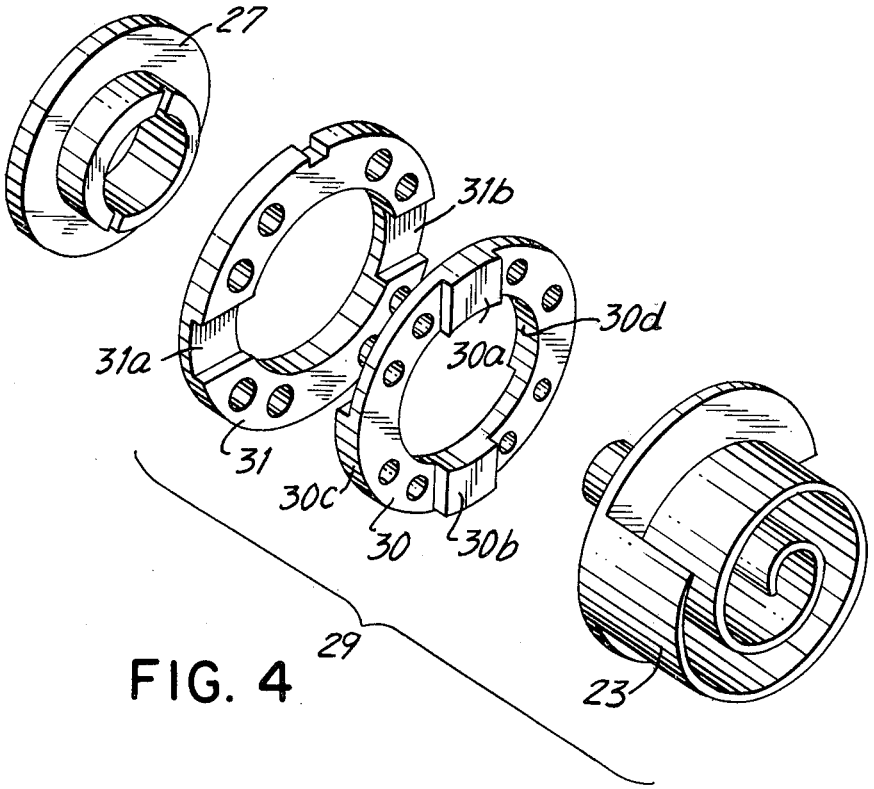
FIG. 4 is a disassembled perspective view of the rotation preventing mechanism in the embodiment of FIG. 2.

Referring to FIGS. 2 and 4, rotation preventing means 29 will be described. Orbiting scroll member 23 is provided with a pair of keyways 234*a* and 234*b* on the front end surface of circular plate 231 which are formed at both sides of boss 233 along a diameter thereof. An Oldham ring 30 is disposed around a cylindrical portion 272 of hollow member 27. Oldham ring 30 is provided with a first pair of keys 30*a* and 30*b* on the surface opposite the front end surface of circular plate 231, which are received in keyways 234*a* and 234*b*. Oldham ring 30 is also provided with a second pair of keys 30*c* and 30*d* on its opposite surface. Keys 30*c* and 30*d* are arranged along a diameter perpendicular to the diameter along which keys 30*a* and 30*b* are arranged. An annular plate 31 is disposed around cylindrical portion 272 of hollow member 27 and between radial flange 271 and Oldham ring 30, and is non-rotatably secured to the inner surface of cylindrical body 13 by key means 32. Annular plate 31 is provided with a pair of keyways 31*a* and 31*b* on the surface opposite Oldham ring 30 for receiving keys 30*c* and 30*d*. Therefore, Oldham ring 30 is slidable in a radial direction along keys 30*c*, 30*d* and by keyways 31*a*, 31*b* but is prevented from rotation. Orbiting scroll member 23 is slidable in the other radial direction along keys 30*a*, 30*b* and by keyways 234*a* and 234*b*, but is prevented from rotation. Accordingly, orbiting scroll member 23 is prevented from rotation, but is permitted to move in two radial directions perpendicular to one another. Therefore, since orbiting scroll member 23 is permitted to move along a circular orbit as a result of, movement in the two radial directions but is prevented from rotation, it effects the orbital motion without rotation due eccentric movement of drive pin 22 and the rotation of drive shaft 15.

Fixed scroll member 24 also comprises an end circular plate 241 and a wrap means or spiral element 242 affixed on one end surface of the circular plate. Circular plate 241 is provided with a hole 243 formed at a position corresponding to the center of spiral element 242. Hole 243 corresponds to discharge port 4 in FIG. 1*a*.

Circular plate 241 is interposed between rear end plate 12 and cylindrical portion 13, and is secured thereto by bolt means 33, in an orientation so that the outer terminal end of spiral element 242 is disposed along the lower side.

Figure 10:
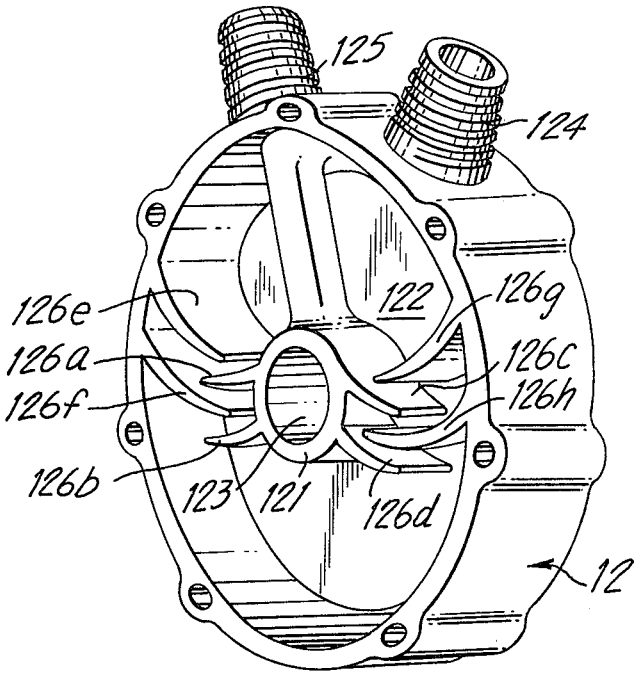
FIG. 10 is a perspective view of rear end plate in FIG. 2.
Figure 11:
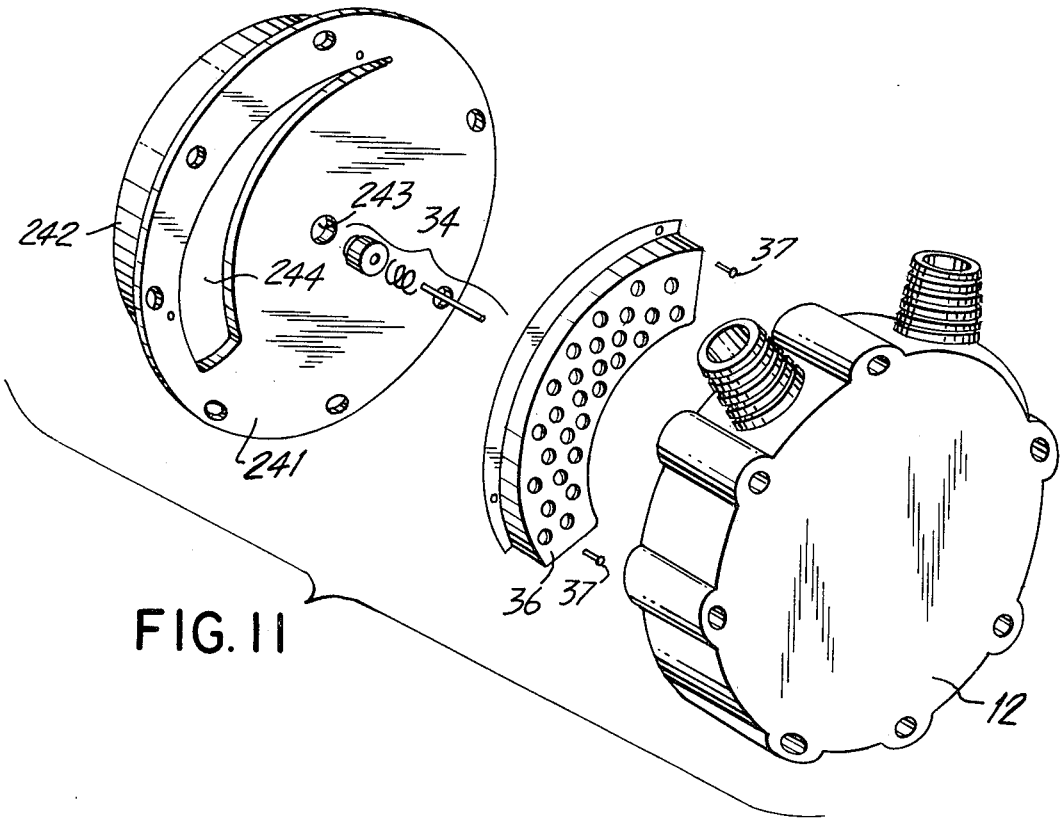
FIG. 11 is a perspective view of the fixed scroll member and the rear end plate, with the oil separator plate and check valve means disassembled therefrom.

Referring to FIG. 10 as well as FIG. 2, rear end plate 12 is provided with an annular projection 121 on its inner surface to partition some into a suction chamber 122 and a discharge chamber 123. The axial projecting end surface of annular projection 121 is in tight contact with the rear end surface of circular plate 241 of fixed scroll member 24 around discharge port 243, so that discharge port 243 connects with discharge chamber 123. Within discharge chamber 123, a check valve 34 is disposed to close discharge port 243. Check valve 34 is illustrated in FIG. 11 in a disassembled condition. Suction chamber 122 and discharge chamber 123 are connected to inlet port 124 and outlet port 125, respectively.

Figure 5:
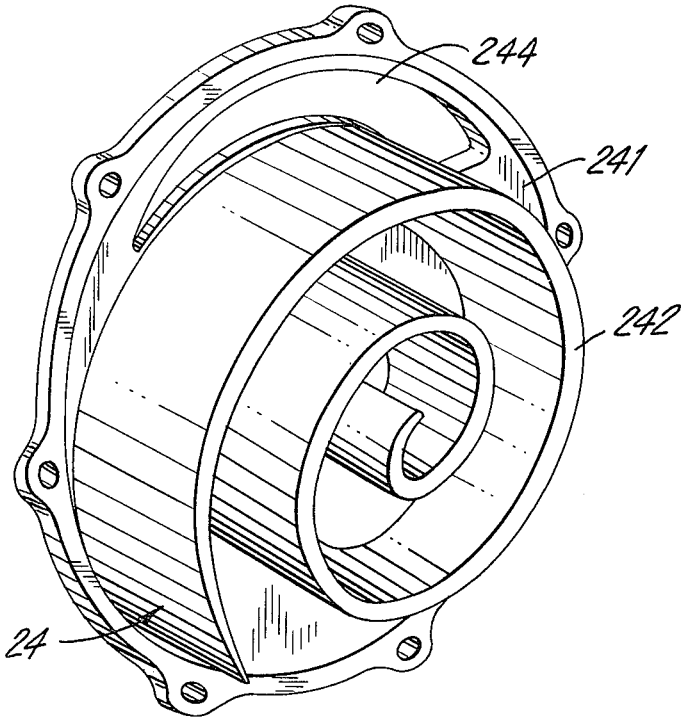
FIG. 5 is a perspective view of the fixed scroll member in the embodiment in FIG. 2.
Figure 6:
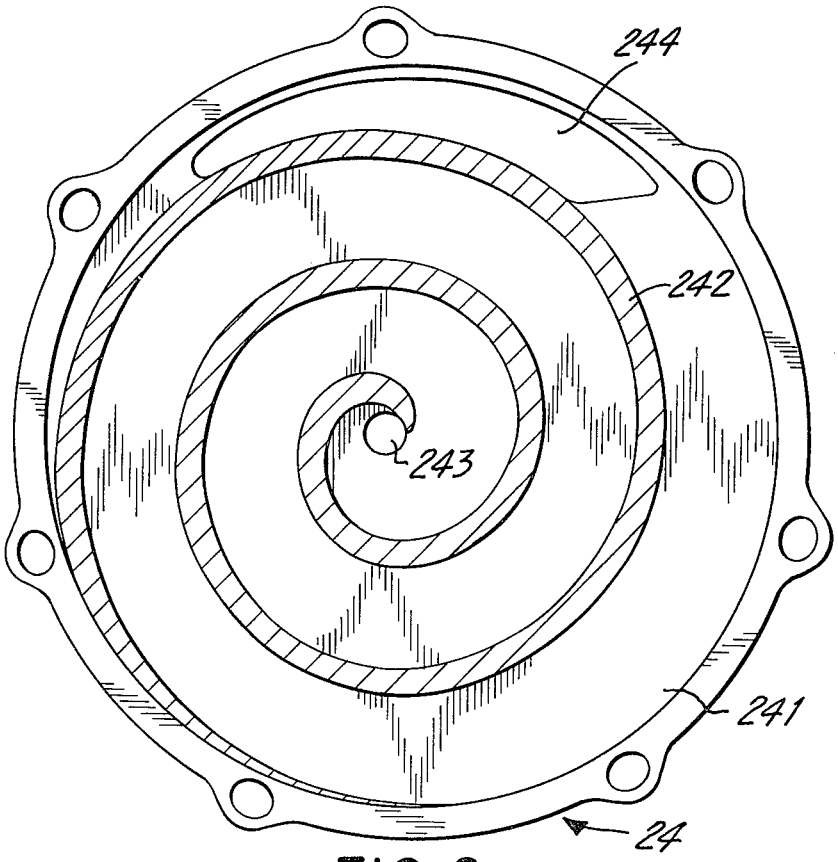
FIG. 6 is a front view of the fixed scroll member.

Referring to FIGS. 5 and 6 in addition to FIG. 2, circular plate 241 is also provided with another hole 244 at a position outside spiral element 242 and at a position opposed to the outer terminal end of spiral element 242 with reference to center hole 243. Therefore, hole 244 is disposed along upper side and adjacent to the outer terminal end of spiral element 232 of orbiting scroll member 23. Accordingly, a chamber 131 defined within the interior of compressor housing by circular end plate 241 is connected with suction chamber 122 through hole 244. Hole 244 is shown crescent-shaped.

In the above described compressor, when drive shaft 15 is rotated by an external power source (not shown), drive pin 22 moves eccentrically to effect the orbital motion of orbiting scroll member 23. At this time, since the rotation of orbiting scroll member 23 is prevented by rotation preventing means 29, the motion of orbiting scroll member 23 in relation to fixed scroll member 24 is similar to that as shown in FIGS. 1*a*–1*d*. Therefore, the fluid or refrigerant gas introduced into chamber 131 through inlet port 124, suction chamber 122 and hole 244 is taken into fluid pockets (3, in FIGS. 1*a*–1*d*) between both scroll members 23 and 24, and is compressed by the orbital motion of orbiting scroll member 23. The compressed fluid is discharged into discharge chamber 123 through hole 243, and, thereafter, discharged through the outlet port to, for example, a cooling circuit. The fluid returns into chamber 131 through inlet port 124, suction chamber 122 and hole 244.

A portion of the fluid introduced into chamber 131 through hole 244 flows into a space between the outer terminal end of spiral element 232 and the adjacent side surface of spiral element 242, because hole 244 is disposed adjacent to the outer terminal end of spiral element 232. The fluid is taken into a fluid pocket which is formed by the orbital motion of orbiting scroll member 23, and is compressed by further motion of orbiting scroll member 23. The operation will be easily understood referring to FIGS. 7*a*–7*d*.

The other portion of the fluid flows between the outer terminal end portion of spiral element 232 and the inner surface (13*a* in FIG. 7*b*) of cylindrical body 13 to the outer terminal end portion of spiral element 242 of fixed scroll member 24 by the motion of orbiting scroll member 23. The fluid flows into a space between the outer terminal end portion of spiral element 242 and the adjacent surface of spiral element 232, and is taken into another pocket which is formed by the orbital motion of orbiting scroll member 23. Thereafter, the fluid is compressed by further motion of orbiting scroll member 23. The operation will be also understood referring to FIGS. 1*a*–1*d*.

As will be understood from the above description, if hole 244 is formed at a position outside spiral element 242 of fixed scroll member 24 and adjacent to the outer terminal end of spiral element 232 of orbiting scroll member 23, the fluid introduced through hole 244 is not only directly taken into the space between the outer terminal end of spiral element 232 and the adjacent spiral element 242 but is also introduced to the space between the outer terminal end of spiral element 242 and the adjacent spiral element 232, so that the introduced fluid is securely taken into all fluid pockets. It will be understood that the fluid can be also fed to the space between the outer terminal end of spiral element 242 and the adjacent spiral element 232 along the outer side of spiral element 232, even if spiral element 242 is extended so that its outer terminal end engages with the inner surface of cylindrical body 13, as shown in FIGS. 5–7*d*. Accordingly, compression ratio can be increased by extending spiral element 232 in correspondance to the extension of spiral element 242 without increase of the diameter of cylindrical body 13 or the compressor housing.

Figure 7A:
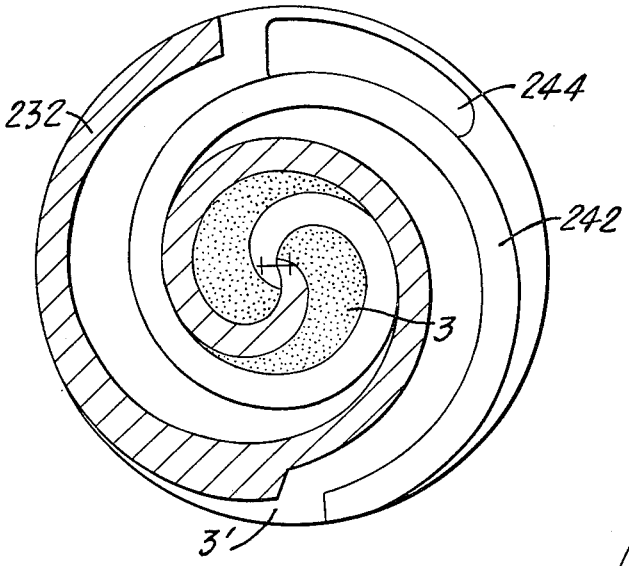
FIGS. 7*a*–7*d* are views of the embodiment in FIG. 2, similar to FIGS. 1*a*–1*d*.
Figure 7C:
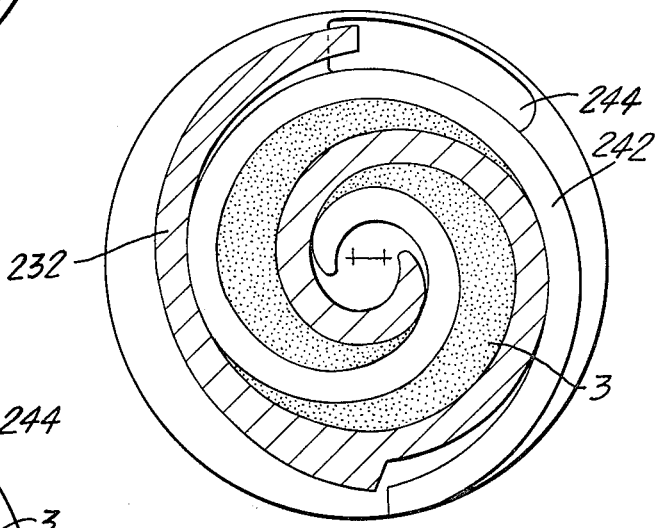
Figure 7B:
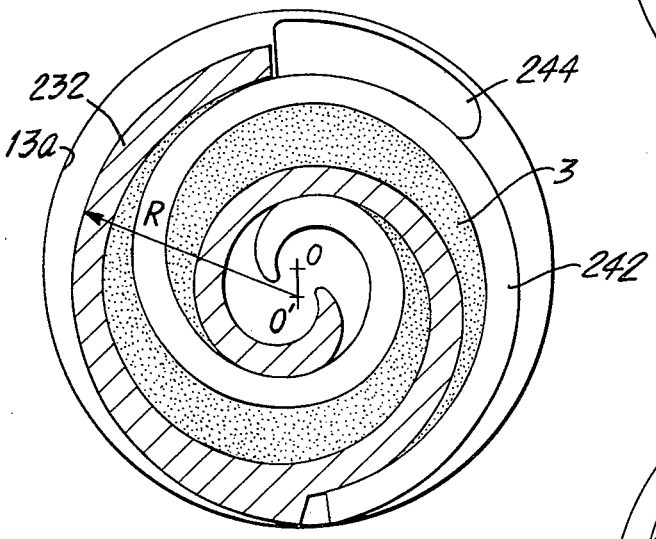
Figure 7D:
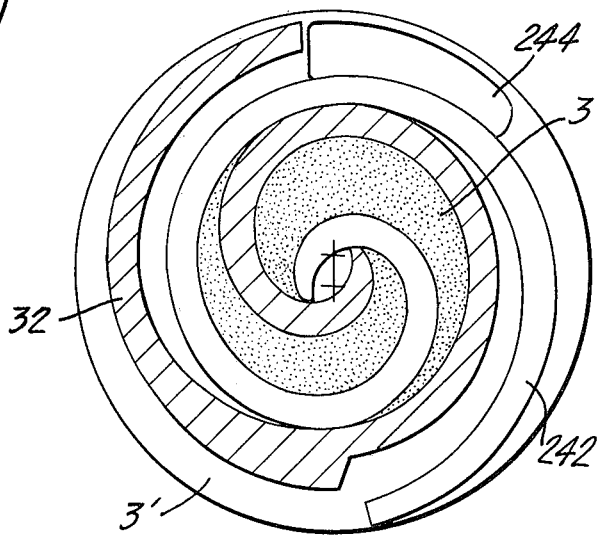

Furthermore, when spiral element 242 is formed so that its outer terminal end engages with the inner surface of cylindrical body 13, the fluid portion which is sent to the space between the outer terminal end of spiral element 242 and the adjacent outer surface of spiral element 232, is pre-compressed during its flow along the outer surface of spiral element 232. That is, the fluid which flows into the gap between the inner surface 13*a* of cylindrical body 13 and the outer surface of spiral element 232 at the state shown in FIG. 7*b*, is confined in the closed space 3' which is formed by inner surface 13*a*, the outer surface of spiral element 232 and the inner surface of spiral element 242 after orbiting scroll member 23 moves into the state shown in FIG. 7*d* via the state shown in FIG. 7*c*.

The pre-compression can be enhanced by forming the outer contour of spiral element 232 at the portion from its outer terminal end to the position which will be contacted with the outer terminal end of spiral element 242 in an arcuate curve having a radius R equal to the length from its spiral center O' to the outer edge of its outer terminal end as shown in FIGS. 7*a*–7*d* to spiral element 232 being formed in a uniform spiral curve over the entire extension.

Referring to FIG. 2 again, a gap is maintained between the peripheral surface of circular plate 231 of orbiting scroll member 23 and the inner surface of cylindrical body 13, in order to permit orbiting scroll member 23 to effect its orbital motion. Therefore, the fluid in the space between the outer surface of spiral element 232 and the inner surface (13*a*, in FIG. 7*b*) of cylindrical body 13 flows out of the space towards spaces between parts of rotation preventing means 29 because of the reduction in size of the space due to the orbital motion of orbiting scroll member 23, so that the pre-compression will not be properly obtained.

In order to secure pre-compression, means are provided to close the gap between the peripheral surface of circular plate 231 of orbiting scroll member 23 and the inner surface of cylindrical body 13.

Figure 8:
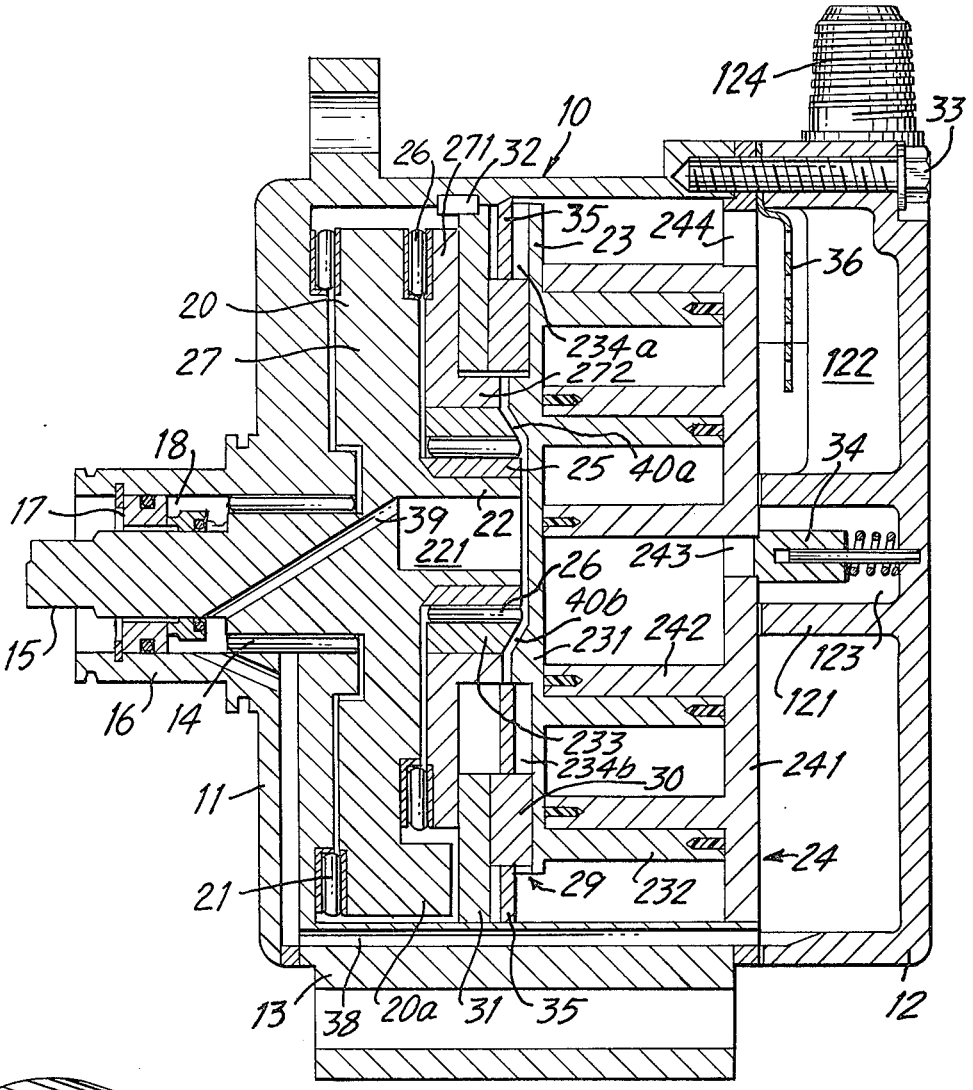
FIG. 8 is a vertical sectional view of a compressor unit of another embodiment of this invention.

Referring to FIG. 8, a ring plate 35 is non-rotatably disposed by means of key and keyway connection within cylindrical body 13 so as to be in contact with the front surface of circular plate 231 of orbiting scroll member 23. Ring plate 35 has an outer diameter equal to the inner diameter of cylindrical body 13 and has an inner diameter shorter than the diameter of circular plate 231 of orbiting scroll member 23 so that it fills the gap between the peripheral end of circular plate 231 and the inner surface of cylindrical body 13 during motion of orbiting scroll member 23. If the inner diameter of ring plate 35 is shorter than the outer diameter of Oldham ring 30, ring plate 35 will then be disposed between Oldham ring 30 and circular plate 231. Therefore, ring plate 35 must be partially cut away to permit a pair of keys 30*a* and 30*b* to be received in keyways 234*a* and 234*b* of circular plate 231 and to permit movement in a radial direction due to the action of another pair of keys 30*c* 30*d* received in keyways 31*a* 31*b*.

The center hole of ring plate 35 need not be circular, but may be an oval hole or another shape.

The other parts shown in the embodiment in FIG. 8 are similar to those of the embodiment in FIGS. 2–7*d*. Therefore, those parts are represented by the same reference numerals as in FIG. 2, and detailed description of those parts is omitted in order to simplify the description.

Figure 9:
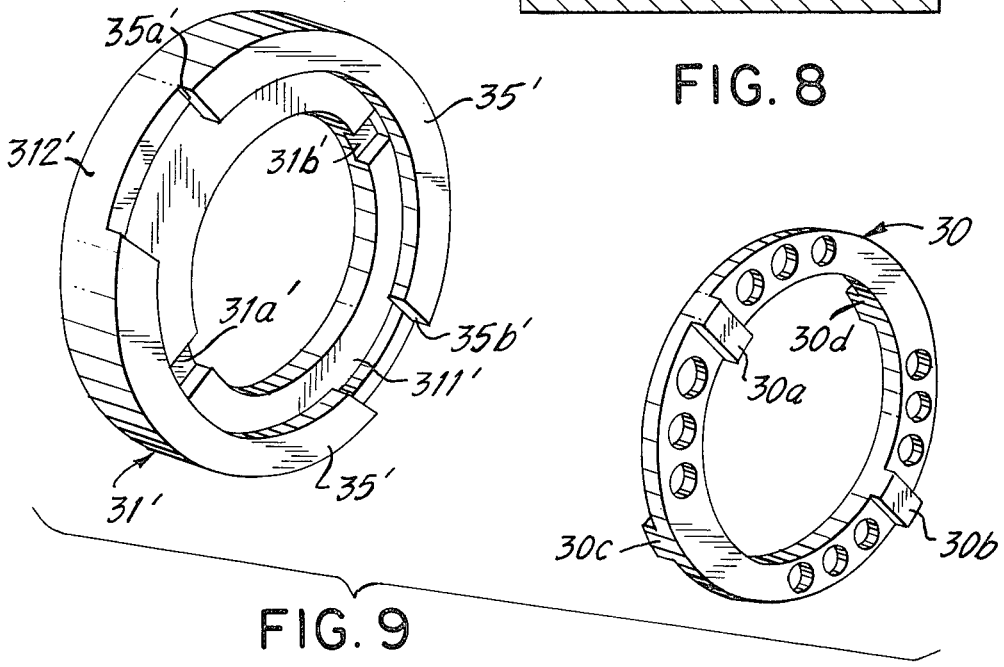
FIG. 9 is a perspective view of the rotation preventing mechanism in a modified embodiment.

FIG. 9 shows a modification of the embodiment shown in FIG. 8, the modification is characterised in that the ring plate is integrally formed with the annular plate, as shown in the drawing. That is, an annular member 31' comprises an annular plate portion 311', a ring plate portion 35' and a cylindrical side wall portion 312' connecting annular plate portion 311' and ring plate portion 35' along their entire peripheral ends. Annular plate portion 311' is provided with keyways 31'*a* and 31'*b* in its axial inner end surface for receiving keys 30*c* and 30*d* of Oldham ring 30. Oldham ring 30 is disposed in a hollow space between annular plate portion 311' and ring plate portion 35'. Ring plate portion 35' is provided with cut away portions 35'*a* and 35'*b* for permitting keys 30*a* and 30*b* of Oldham ring 30 to be received in keyways (234*a* and 234*b* in FIG. 8) of circular plate 231 of orbiting scroll member 23 and to move in a radial direction.

According to another aspect of this invention, the compressor unit is provided with an improved lubricating system.

Referring to FIG. 2, lubricating oil is contained in the lower portion of chamber 131 which is defined by front end plate 11, cylindrical body 13 and circular plate 241 of fixed scroll member 24. During operation, the oil is splashed by disk rotor 20 and agitated by the other moving parts, so that oil adheres onto the moving parts and lubricates them.

A part of the oil is taken into the fluid pockets and discharged together with the refrigerant gas from hole 243 and outlet port 125 to the external circuit.

Referring to FIGS. 10 and 11 in addition to FIG. 2, an oil separator plate 36 is fixedly disposed within suction chamber 122 to interrupt the oil flow into hole 244. Oil separator plate 36 is formed from perforated plate and is fixed to circular plate 241 by screw means 37, as shown in FIG. 11.

The fluid, or refrigerant gas which is introduced into suction chamber 122 through inlet port 124 strikes oil separator plate 36 before flowing into hole 244, so that the lubricating oil mixed in the refrigerant gas adheres oil separator plate 36 and is separated from the refrigerant gas. The separated oil drops and is accumulated in the lower portion of suction chamber 122.

An oil passageway 38 is formed to extend through circular plate 241, walls of cylindrical body 13 and front end plate 11 to connect the lower portion of suction chamber 122 and shaft seal cavity 18. Therefore, the oil accumulated in the lower portion of suction chamber 122 flows into shaft seal cavity 18 through oil passageway 38 to lubricate shaft seal assembly 17.

When the drive shaft 15 rotates, the pressure in the gap between rotor 20, the inner surface of front end plate 11 and depression 221 in eccentric boss 22 is lowered by the centrifugal force in comparison with shaft seal cavity 18. Therefore, the oil in the shaft seal cavity is drawn into the gap through bearing 14 and into depression 221 through oil passageway 39. Accordingly, the oil in suction chamber is also drawn into shaft seal cavity through passageway 38. A part of the oil flows, therefrom, through bearing 14 into a gap between disk rotor 20 and front end plate 11 and returns to chamber 131 after lubricating thrust bearing 21.

Another oil passageway 39 is formed through drive shaft 15 and disk rotor 20 to connect shaft seal cavity 18 and a depression 221 formed in drive pin 22. Accordingly, the other part of the oil in shaft seal cavity 18 flows into depression 221 through oil passageway 39 and returns to chamber 131 lubricating radial bearing 25 and thrust bearing 28.

Radial oil passageways 40*a* and 40*b* are formed through boss 233 and hollow member 27 to feed the oil from depression 221 to rotation preventing means 29. Thus, keys 30*a*–30*d* of Oldham ring 30 and keyways 234*a*, 234*b*, 31*a* and 31*b* are lubricated.

In order to prevent the refrigerant gas introduced into suction chamber 122 through inlet port 124 from agitating the oil accumulated in the lower portion of suction chamber 122, rear end plate 12 is provided with shield plate portions 126 in suction chamber 122, as shown in FIG. 10. In the arrangement shown, two pairs of plate portions 126*a*–126*b* and 126*c*–126*d* are formed and extend radially inclined from partitioning annular projection 121 in opposite directions. Another two pairs of plate portions 126*e*–126*f* and 126*g*–126*h* are formed and extend radially inclined from the inner side surface of rear end plate 12 at opposite positions so that a pair of plate portions 126*a*–126*b* engages with another pair of plate portions 126*e*–126*f*. Another pair of plate portions 126*c*–126*d* engage the other pair of plate portions 126*g*–126*h*. Accordingly, the introduced fluid is prevented from blowing into the lower portion under shield plate portions 126*a*–126*h* so that the accumulated oil therein is not agitated. The oil separated by oil separator plate 36 drops onto shield plate portions 126*a*–126*h* and flows along them into the lower portion of suction chamber 122.

This invention has been described in detail in connection with preferred embodiments, but these are merely for example only and this invention is not restricted thereto. It will be easily understood by those skilled in the art that the other variations and modifications can be easily made within the scope of this invention.

What is claimed is:

1. A scroll type compressor unit comprising:

a compressor housing having a fluid inlet port and a fluid outlet port, said housing includes a rear end plate, said rear end plate having a fluid suction chamber connected to said fluid inlet port and a fluid discharge chamber connected to said fluid outlet port, a fixed scroll member fixedly disposed within said compressor housing and having first end plate means lying in a substantially vertical direction to which first wrap means are affixed, a first chamber defined by the inner surface of said compressor housing and said first end plate means of said fixed scroll member and containing said first wrap means therein, an orbiting scroll member orbitally disposed within said first chamber and having second end plate means to which second wrap means are affixed, said first and second wrap means interfitting at an angular offset of 180° with a plurality of line contacts to define at least one sealed off fluid pocket which moves with a consequent reduction of volume thereof by the orbital motion of said orbiting scroll member, to thereby compress the fluid in the pocket, said first end plate means at an upper portion thereof being provided with a first hole outside said first wrap means and adjacent to the outer terminal end of said second wrap means, a second hole at a position corresponding to the center of said first wrap means, said first hole being connected through said suction chamber to said fluid inlet port to thereby introduce the fluid from said inlet port into said first chamber so that a portion of the fluid enters the space between said outer terminal end portion of said second wrap means and the adjacent first wrap means to be compressed, with the other portion of said fluid flowing along said second wrap means into another space between the outer terminal end portion of said first wrap means and the adjacent second wrap means to be compressed, oil separator means disposed within said suction chamber to prevent said fluid from directly flowing into said first hole to thereby separate lubricating oil mixed in the fluid, an oil passageway connecting said first chamber and the lower portion of said suction chamber to return the separated oil into said first chamber, and said second hole being connected through said discharge chamber to said fluid outlet port so that the compressed fluid is discharged from said second hole and said outlet port.

2. The compressor as claimed in claim 1, wherein said housing includes a front end plate, a drive shaft rotatably mounted in said front end plate by first bearing means, said front end plate having a shaft seal cavity which surrounds said drive shaft, a shaft seal assembly mounted on said drive shaft within said shaft seal cavity, a drive pin connected with the inner end of said drive shaft and being offset from said drive shaft to effect eccentric movement due to the rotation of said drive shaft, said second scroll member being rotatably mounted on said drive pin by second bearing means, and said oil passageway including a first portion connecting the lower portion of said suction chamber and said shaft seal cavity and a second portion connecting said shaft seal cavity and the axial end surface of said drive pin, whereby the oil in said suction chamber flows into said shaft seal cavity to lubricate said shaft seal assembly and a part of the oil, therefrom, returns into said first chamber lubricating said first bearing means, with the other part flowing through said second portion to the axial end of said drive pin and, therefrom, returning into said first chamber to lubricate said second bearing means.

3. The compressor as claimed in claim 2, further including said orbiting scroll member being provided with an axial boss which is formed on a surface of said second end plate means opposite said second wrap means, said drive pin being fitted into said boss with said second bearing means therebetween to rotatably support said orbiting scroll member, annular plate means non-rotatably mounted in said housing opposing an axial end surface of said second end plate means and opposite to said second wrap means, an Oldham ring member disposed between said annular plate means and said second end plate means and being connected by key and keyway connections to both annular plate means and said second end plate means so as to be slidable in a first radial direction in relation to said annular plate means, said second end plate means being slidable in a second radial direction perpendicular to said first radial direction in relation to said Oldham ring, and said boss being provided with at least one radial oil hole through which said lubricating oil flows from the interior of said boss to said Oldham ring so that key and keyway connections between said Oldham ring and both said annular plate means and said second end plate means are lubricated.

4. A scroll type compressor unit comprising:

a compressor housing with a cylindrical inner surface, a fixed scroll member fixedly disposed within said compressor housing and having first end plate means to which first wrap means are affixed, the outer terminal end of said first wrap means extending on said first end plate means so that it engages the inner surface of said compressor housing, an orbiting scroll member orbitally disposed within said housing and having second end plate means to which second wrap means are affixed, said second wrap means having the same number of turns as said first wrap means with a portion thereof from its outer terminal end to a position so as to connect with the outer terminal end of said first wrap means having an outer contour of an arcuate curve of a radius equal to the length from its spiral center to the outer edge of its outer terminal end, first means for closing the gap between the outer peripheral end of said second end plate and said cylindrical inner surface of said compressor housing but permitting the orbital motion of said orbiting scroll member, said first and second wrap means interfitting at an angular offset of 180° with a plurality of line contacts to define at least one pair of sealed off fluid pockets which move with a consequent reduction of volume thereof by the oribital motion of said orbiting scroll member to thereby compress the fluid in the pocket.

5. The compressor as claimed in claim 4 wherein said first means comprises a ring plate member having an outer diameter equal to the inner diameter of said housing and which is non-rotatably mounted in said housing in contact with an opposite surface of said second end plate means opposite said second wrap means, and the inner diameter of said ring plate member being sufficiently shorter than the diameter of said second end plate means so as to secure the contact between said ring plate member and said second end plate means during the orbital motion of said orbiting scroll member.

6. The compressor as claimed in claim 5, which further includes a drive shaft rotatably mounted on said housing, a drive pin connected to said drive shaft and being offset radially from said drive shaft to effect eccentric movement due to the rotation of said drive shaft, said second scroll member being rotatably mounted on said drive pin, annular plate means non-rotatably mounted in said housing opposing an axial end surface of said second end plate means and opposite to said second wrap means, an Oldham ring member disposed between said annular plate means and said second end plate means and being connected by key and keyway connections to both of said annular plate means and said second end plate means so as to be slidable in a first radial direction in relation to said annular plate means, said second end plate means being slidable in a second radial direction perpendicular to said first radial direction relative to said Oldham ring, said ring plate member disposed between said Oldham ring and said second end plate means, and said ring plate member being provided with cut-away portions to permit said key and keyway connection between said Oldham ring and said second plate means.

7. The compressor as claimed in claim 6, wherein said annular plate means and said ring plate member are integrally formed with one another.

* * * * *